US010604381B2

(12) United States Patent
Inoue

(10) Patent No.: US 10,604,381 B2
(45) Date of Patent: Mar. 31, 2020

(54) PASSENGER CONVEYOR LIFTING DEVICE AND PASSENGER CONVEYOR LIFTING METHOD

(71) Applicant: MITSUBISHI ELECTRIC CORPORATION, Chiyoda-ku (JP)

(72) Inventor: Akihiko Inoue, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 640 days.

(21) Appl. No.: 15/312,796

(22) PCT Filed: Jul. 9, 2014

(86) PCT No.: PCT/JP2014/068325

§ 371 (c)(1),
(2) Date: Nov. 21, 2016

(87) PCT Pub. No.: WO2016/006061

PCT Pub. Date: Jan. 14, 2016

(65) Prior Publication Data

US 2017/0183201 A1 Jun. 29, 2017

(51) Int. Cl.
*B66F 7/12* (2006.01)
*B66B 23/00* (2006.01)
(Continued)

(52) U.S. Cl.
CPC ..... *B66B 23/00* (2013.01); *B66B 31/00* (2013.01); *B66F 19/00* (2013.01)

(58) Field of Classification Search
USPC ..... 254/89 R, 100, 134; 198/312, 796, 198/860.1, 860.2, 861.1
See application file for complete search history.

(56) References Cited

U.S. PATENT DOCUMENTS 2,735,713 A * 2/1956 Blakely ..... B66C 1/585 294/119.1
6,581,995 B1 * 6/2003 Zaayman ..... B66C 1/12 294/68.3
(Continued)

FOREIGN PATENT DOCUMENTS

DE 7329570 U 6/1973
JP 06255966 A 9/1994
(Continued)

OTHER PUBLICATIONS

International Search Report dated Oct. 14, 2014 in PCT/JP2014/068325 filed Jul. 9, 2014.
(Continued)

*Primary Examiner* — Joseph J Hail
*Assistant Examiner* — Shantese L McDonald
(74) *Attorney, Agent, or Firm* — Xsensus LLP

(57) ABSTRACT

A passenger conveyor lifting device lifts a unit that includes a frame body constituting at least one lengthwise direction part of a main frame of a passenger conveyor, and a unit device supported by the frame body. The lifting device includes a lifting attachment fitting and a lifting rope. The lifting attachment fitting includes a pair of attachment bases attached detachably to respective upper surfaces of a pair of side frame portions constituting respective width direction end portions of the frame body, and a reinforcing member connecting the pair of attachment bases above the unit device disposed between the pair of side frame portions. The lifting rope lifts the unit while hooked to the respective side frame portions.

17 Claims, 2 Drawing Sheets

(51) Int. Cl.
*B66B 31/00* (2006.01)
*B66F 19/00* (2006.01)

(56) References Cited

U.S. PATENT DOCUMENTS

| | | | | |
|---|---|---|---|---|
| 7,093,729 | B2 * | 8/2006 | Monteil | B66C 23/74 212/178 |
| 8,550,517 | B1 * | 10/2013 | Bates | B66C 1/625 294/119.1 |
| 8,740,189 | B2 * | 6/2014 | Klein | B66F 3/08 254/100 |
| 9,440,820 | B2 * | 9/2016 | Sullivan | B66B 31/00 |

FOREIGN PATENT DOCUMENTS

| | | | |
|---|---|---|---|
| JP | 7-277661 | A | 10/1995 |
| JP | 9-2767 | A | 1/1997 |
| JP | 10250964 | A | 9/1998 |
| JP | 2000-198648 | A | 7/2000 |
| JP | 2005298189 | A | 10/2005 |
| JP | 2007-290826 | A | 11/2007 |
| JP | 2008-180165 | A | 8/2008 |

OTHER PUBLICATIONS

Office Action issued in German Application 11 2014 006 791.1 dated Jan. 18, 2019.
German Office Action dated Jun. 3, 2019 in German Application No. 11 2014 006 791.1.

* cited by examiner

PASSENGER CONVEYOR LIFTING DEVICE AND PASSENGER CONVEYOR LIFTING METHOD

TECHNICAL FIELD

This invention relates to a passenger conveyor lifting device and a passenger conveyor lifting method for lifting a unit constituting at least a part of a passenger conveyor (an escalator, a moving walkway, or the like, for example).

BACKGROUND ART

In a conventional passenger conveyor lifting method proposed with the aim of facilitating a passenger conveyor installation operation, handrail design components are attached in advance to a plurality of frame bodies obtained by dividing a main frame of a passenger conveyor, and the respective frame bodies are lifted individually with the handrail design components attached to the frame bodies. In this conventional passenger conveyor lifting method, lifted members are fixed between vertical members of left and right side frames while disposed horizontally within the frame body. A wire rope is then connected to the lifted members, whereupon the frame body is lifted by the wire rope with the handrail design components attached to the frame body (see PTL 1).

CITATION LIST

Patent Literature

[PTL 1] Japanese Patent Application Publication No. 2000-198648

SUMMARY OF INVENTION

Technical Problem

With the passenger conveyor lifting method disclosed in PTL 1, however, the lifted members are fixed within the frame body, and therefore any device (a step or the like, for example) that interferes with the lifted members and the wire rope, among devices supported by the frame body, must be removed from the frame body. Accordingly, an operation is required to attach the device that was removed to avoid interference with the lifted members and the wire rope to the frame body after lifting the frame body. Moreover, the wire rope that lifts the frame body is connected to the inner sides of the left and right side frames, and therefore the attitude of the frame body lifted by the wire rope easily becomes unstable. As a result, the operation to install the passenger conveyor is laborious.

Furthermore, the lifted members are fixed to the vertical members of the side frames of the frame body, and therefore, to ensure that the vertical members are strong enough, the structural complexity and weight of the frame body must be increased.

This invention has been designed to solve the problems described above, and an object thereof is to obtain a passenger conveyor lifting device and a passenger conveyor lifting method with which increases in the structural complexity and weight of a frame body can be suppressed, and the amount of labor involved in an operation to install a passenger conveyor can be reduced.

Solution to Problem

A passenger conveyor lifting device according to this invention lifts a unit that includes a frame body constituting at least one lengthwise direction part of a main frame of a passenger conveyor, and a unit device supported by the frame body. The passenger conveyor lifting device includes: a lifting attachment fitting that includes a pair of attachment bases attached detachably to respective upper surfaces of a pair of side frame portions constituting respective width direction end portions of the frame body, and a reinforcing member connecting the pair of attachment bases above the unit device disposed between the pair of side frame portions; and a lifting rope that lifts the unit while hooked to the respective side frame portions.

Advantageous Effects of Invention

With the passenger conveyor lifting device and passenger conveyor lifting method according to this invention, the number of unit devices, among the unit devices supported by the frame body, that are removed from the frame body in order to lift the frame body can be reduced, and the frame body can be lifted with stability. As a result, the amount of labor involved in the operation to install the passenger conveyor can be reduced. Further, increases in the structural complexity and weight of the frame body can be suppressed while preventing the frame body from deforming when lifted.

DESCRIPTION OF EMBODIMENTS

A preferred embodiment of this invention will be described below with reference to the drawings.

First Embodiment

Figure 1:
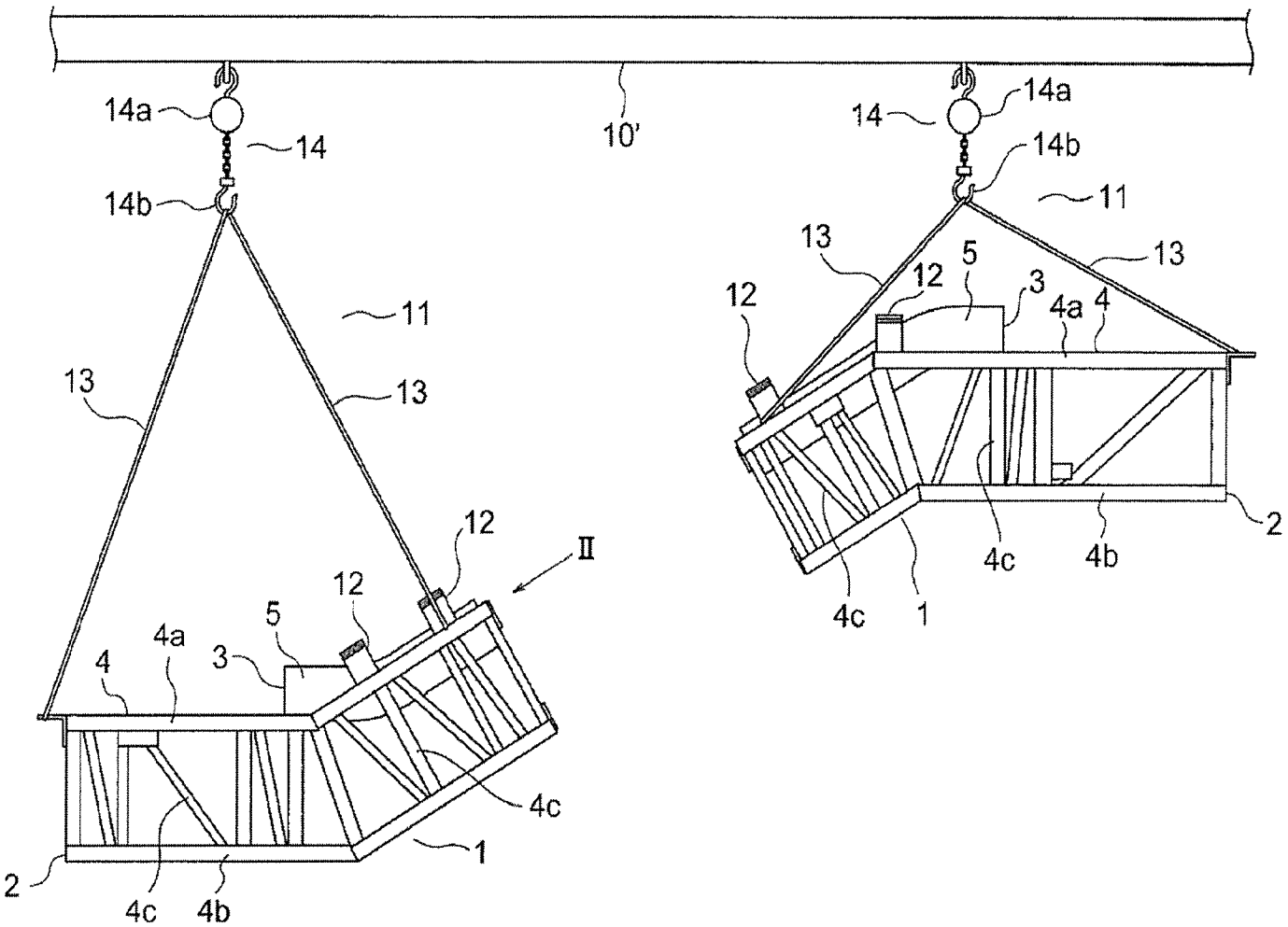
FIG. 1 is a side view showing an escalator lifting device according to a first embodiment of this invention and a unit lifted by the lifting device.
Figure 2:
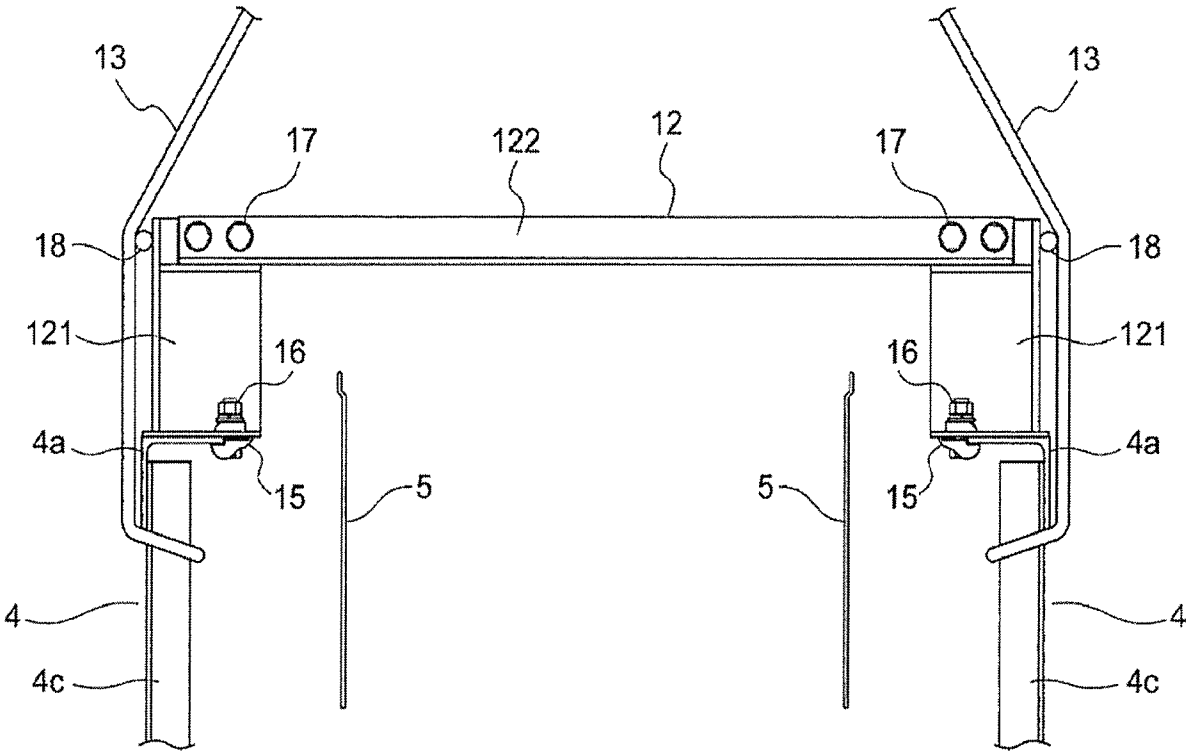
FIG. 2 is a front view showing the unit from the viewpoint of an arrow II in FIG. 1.

FIG. 1 is a side view showing an escalator lifting device according to a first embodiment of this invention and a unit lifted by the lifting device, and FIG. 2 is a front view showing the unit from the viewpoint of an arrow II in FIG. 1. An escalator serving as a passenger conveyor is installed at an incline between an upper floor and a lower floor. Further, the escalator is installed between the upper floor and the lower floor by arranging a plurality of units 1 so as to extend from one of the upper floor and the lower floor to the other, and connecting adjacent units 1 to each other. In this example, an upper floor side unit 1 supported by an upper floor receiving beam and a lower floor side unit 1 supported by a lower floor receiving beam are connected to each other, and therefore the number of units 1 included in the escalator is two.

Each unit 1 includes a frame body 2 constituting a lengthwise direction part of a main frame of the escalator, and a unit device 3 supported by the frame body 2.

The main frame of the escalator is formed by connecting the frame bodies 2 of the respective units 1 arranged in the lengthwise direction of the escalator to each other. Each frame body 2 includes a pair of side frame portions 4 forming respective width direction end portions of the frame body 2, and a plurality of width direction members (angle bars), not shown in the drawings, that are fixed between respective lower end portions of the pair of side frame portions 4 so as to form a bottom portion of the frame body 2. As shown in FIG. 1, each side frame portion 4 includes an upper lengthwise direction beam 4*a* and a lower lengthwise direction beam 4*b* disposed at a vertical remove from each other, and a plurality of vertical members 4*c* fixed between the upper lengthwise direction beam 4*a* and the lower lengthwise direction beam 4*b*. Respective strengths of the upper lengthwise direction beam 4*a* and the lower lengthwise direction beam 4*b* are set to be greater than the strength of the vertical members 4*c*. The width direction members are fixed between the lower lengthwise direction beams 4*b* of the pair of side frame portions 4.

The unit device 3 includes a plurality of steps (not shown) connected by a step chain, and a plurality of plate-shaped skirt guards 5 that oppose respective side faces of the steps via a gap. When the respective units 1 are arranged in the lengthwise direction of the escalator, the plurality of steps of each unit device 3 are connected endlessly by the step chain. The endlessly connected steps circulate between the upper floor and the lower floor in response to driving force from a driving device, not shown in the drawings.

Each skirt guard 5 is attached to the vertical members 4*c* of the side frame portion 4 via an attachment arm, not shown in the drawings. Further, each skirt guard 5 is supported by the frame body 2 so that a part of the skirt guard 5 projects upward beyond the height of an upper surface of the frame body 2 (in other words, an upper surface of the upper lengthwise direction beam 4*a*). As a result, the position of an upper end portion of the skirt guard 5 is higher than the position of the upper surface of the frame body 2.

When the escalator is to be installed between the upper floor and the lower floor, a lifting device 11 transports the respective units 1 while lifting the units 1 individually. The lifting device 11 includes a plurality of lifting attachment fittings 12 attached to the frame body 2, a lifting rope 13 that lifts the unit 1 while hooked to the frame body 2, and a chain block (a crane) 14 that moves the lifting rope 13 up and down together with the unit 1.

In this example, as shown in FIG. 1, two lifting attachment fittings 12 are attached to a shared frame body 2 at a remove from each other in the lengthwise direction of the frame body 2. As shown in FIG. 2, each lifting attachment fitting 12 includes a pair of attachment bases 121 attached to the upper surfaces of the respective upper lengthwise direction beams 4*a* (in other words, the upper surfaces of the pair of side frame portions 4), and a reinforcing member 122 that connects the pair of attachment bases 121.

The pair of attachment bases 121 are disposed in identical positions in the lengthwise direction of the frame body 2. When the attachment base 121 is attached to the upper surface of the upper lengthwise direction beam 4*a*, the position of an upper end portion of the attachment base 121 is higher than the position of the upper end portion of the skirt guard 5.

A rail clip 15 is attached to a lower surface of each attachment base 121 by a fastener 16. The fastener 16 includes a bolt that penetrates a lower end portion of the attachment base 121 and the rail clip 15, and a nut screwed to the bolt. The attachment base 121 is attached to the upper surface of the upper lengthwise direction beam 4*a* by fastening the rail clip 15 using the fastener 16 with an upper portion of the upper lengthwise direction beam 4*a* sandwiched between the rail clip 15 and the lower surface of the attachment base 121.

The reinforcing member 122 is an angle bar attached detachably to the pair of attachment bases 121. In this example, the reinforcing member 122 is attached to respective upper end portions of the attachment bases 121 by bolts 17. The lifting attachment fitting 12 is attached to the respective upper surfaces of the upper lengthwise direction beams 4*a* such that the reinforcing member 122 is disposed above the skirt guard 5 and extends in the width direction of the frame body 2. A length of the reinforcing member 122 is determined in accordance with a distance between the pair of attachment bases 121 attached to the respective side frame portions 4. In this example, a plurality of reinforcing members 122 of different lengths are prepared, and a reinforcing member 122 having a length that matches the distance between the pair of attachment bases 121 attached the respective side frame portions 4 is selected from the plurality of prepared reinforcing members 122 and attached between the pair of attachment bases 121.

The chain block 14 is attached to an architectural beam 10 positioned above the unit 1. Further, the chain block 14 includes a chain block main body (a crane main body) 14*a*, and a hook 14*b* suspended from the chain block main body 14*a* via a mobile chain. The hook 14*b* moves up and down relative to the chain block main body 14*a* in response to movement of the mobile chain. The lifting rope 13 is hooked onto the hook 14*b*. When the lifting rope 13 is hooked onto the hook 14*b* while the unit 1 is suspended therefrom, the unit 1 is moved up and down by moving the hook 14*b* up and down relative to the chain block main body 14*a*.

In the lengthwise direction of the frame body 2, as shown in FIG. 1, the lifting rope 13 is hooked to a position at the end portion of the frame body 2 and a position of the frame body 2 to which the lifting attachment fitting 12 is attached. Further, in the width direction of the frame body 2, as shown in FIG. 2, the lifting rope 13 is hooked to each of the pair of side frame portions 4.

As shown in FIG. 2, on each side frame portion 4, the lifting rope 13 is hooked to an intersecting portion between the vertical member 4*c* and the upper lengthwise direction beam 4*a*. Parts of the lifting rope 13 corresponding to the position of the lifting attachment fitting 12 extend along width direction outer sides of the lifting attachment fitting 12 from the respective side frame portions 4, and reach the hook 14*b* of the chain block 14 thereabove while approaching each other.

Rope receiving members 18 for individually receiving the parts of the lifting rope 13 that reach the hook 14*b* from the respective side frame portions 4 are attached to respective side faces of the lifting attachment fitting 12. By having the rope receiving members 18 receive the lifting rope 13, contact between the lifting rope 13 and the lifting attachment fitting 12 is avoided. A surface of the rope receiving member 18 that receives the lifting rope 13 is curved. As a result, damage to the lifting rope 13 upon contact with the rope receiving members 18 is prevented. In this example, the rope receiving members 18 are round bars having a circular cross-section.

Next, a lifting method for lifting the unit 1 using the lifting device 11 will be described. In an escalator manufacturing plant, the plurality of units 1 are manufactured by attaching the unit device 3 to the frame body 2 while adjusting the position of the unit device 3 relative to the frame body (unit manufacturing process), whereupon the lifting attachment fittings 12 are attached to the frame body 2 of the unit 1. When the lifting attachment fitting 12 is attached to the unit 1, the respective attachment bases 121 are attached to the respective upper surfaces of the frame body 2 such that the reinforcing member 122 is disposed above and away from the unit device 3 (lifting attachment fitting attachment process). The units 1 are then transported to an escalator installation site with the lifting attachment fittings 12 attached thereto.

Next, on the escalator installation site, the lifting rope 13 is hooked to the respective side frame portions 4 of the frame body 2. At this time, the lifting rope 13 is hooked to the intersecting portions between the upper lengthwise direction beams 4*a* and the vertical members 4*c* of the respective side frame portions 4, and passed over the outer sides of the rope receiving members 18 in the width direction of the lifting attachment fitting 12. Further, on the escalator installation site, the chain block 14 is attached to the architectural beam 10, whereupon the lifting rope 13 is hooked onto the hook 14*b* of the chain block 14 (lifting rope hooking process).

Next, the hook 14*b* of the chain block 14 is moved up and down with the lifting rope 13 hooked to the hook 14*b*, whereby the unit 1 is suspended from the lifting rope 13 and lifted together therewith. The unit 1 is then transported while being lifted, and installed in an installation location (lifting process).

Once the unit 1 has been installed in the installation location, the lifting rope 13 is removed from the hook 14*b* of the chain block 14 and the respective side frame portions 4, and the lifting attachment fittings 12 are removed from the frame body 2 (dismantling process). The operation to lift the unit 1 is thereby completed.

In this escalator lifting device, the lifting attachment fitting 12 includes the pair of attachment bases 121 attached detachably to the respective upper surfaces of the side frame portions 4, and the reinforcing member 122 that connects the pair of attachment bases 121 above the unit device 3, and therefore the lifting attachment fitting 12 and the lifting rope 13 can be prevented from interfering with the unit device 3. As a result, the unit 1 can be lifted without removing a part of the unit device 3 from the frame body 2. For example, when the skirt guard 5 is attached to the frame body 2, the position of the skirt guard 5 must be adjusted with respect to the positions of the steps. When an operation to adjust the position of the skirt guard 5 is performed on the escalator installation site, the working environment is poor in terms of scaffolding and the like, and therefore the operation takes longer than in the escalator manufacturing plant. With this invention, the unit 1 can be lifted while the skirt guard 5 is attached to the frame body 2, and therefore the position of the skirt guard 5 can be adjusted in advance in the escalator manufacturing plant, enabling a reduction in the amount of time required for the work performed on the escalator installation site. Furthermore, the unit 1 is lifted by the lifting rope 13 hooked to the pair of side frame portions 4, and therefore a distance, in the width direction of the frame body 2, between the locations in which the frame body 2 is lifted by the lifting rope 13 can be increased so that the unit 1 can be lifted with stability. As a result, the amount of labor involved in the operation to install the escalator can be reduced.

Moreover, the lifting attachment fitting 12 does not have to be attached to the vertical members 4*c* of the side frame portions 4 in order to lift the unit 1, and therefore increases in the size and complexity of the vertical members 4*c* can be suppressed. Furthermore, even when force is exerted on the frame body 2 inwardly in the width direction when the unit 1 is lifted by the lifting rope 13, deformation of the frame body 2 in the width direction can be suppressed by the lifting attachment fitting 12. As a result, increases in the structural complexity of the frame body 2 and the weight of the frame body 2 can also be suppressed.

Further, in this escalator lifting method, the unit 1 is lifted by the lifting rope 13 after attaching the lifting attachment fitting 12 to the upper surfaces of the pair of side frame portions 4 such that the reinforcing member 122 is disposed above the unit device 3, and hooking the lifting rope 13 to the pair of side frame portions 4. Therefore, the lifting attachment fitting 12 and the lifting rope 13 can be prevented from interfering with the unit device 3, and as a result, the unit 1 can be lifted without removing the unit device 3 from the frame body 2. Moreover, the unit 1 can be lifted by the lifting rope 13 with stability. As a result, the amount of labor involved in the operation to install the escalator can be reduced. Furthermore, increases in the structural complexity and size of the vertical members 4*c*, and accordingly increases in the structural complexity and weight of the frame body 2, can be suppressed while suppressing deformation of the frame body 2 when the unit 1 is lifted by the lifting rope 13.

Moreover, the attachment base 121 is attached to the upper lengthwise direction beam 4*a* of the side frame portion 4 by the rail clip 15 and the fastener 16, and therefore the attachment base 121 can be attached to the side frame portion 4 easily without the need for processing such as drilling a hole in the side frame portion 4, for example. Further, the attachment base 121 can be attached to any position on the upper surface of the side frame portion 4, enabling an increase in the freedom to select the position in which the attachment base 121 is attached to the side frame portion 4.

Furthermore, the rope receiving members 18 that receive the lifting rope 13 are provided on the side faces of the lifting attachment fitting 12, and the surfaces of the rope receiving members 18 that receive the lifting rope 13 are curved. Therefore, the lifting rope 13 can be prevented from becoming damaged upon contact with the rope receiving members 18. Moreover, by having the rope receiving members 18 receive the lifting rope 13, the lifting rope 13 can be prevented from contacting the lifting attachment fitting 12, and therefore damage to the lifting rope 13 caused by contact with the lifting attachment fitting 12 can be prevented.

Further, the reinforcing member 122 can be attached detachably to the pair of attachment bases 121, and therefore reinforcing members 122 of different lengths can be attached selectively between the pair of attachment bases 121. Hence, by varying the reinforcing member 122 provided between the pair of attachment bases 121, the width dimension of the lifting attachment fitting 12 can be adjusted, and as a result, the lifting attachment fitting 12 can be attached to the pair of side frame portions 4 easily even when the width dimension of the plurality of units 1 varies.

Note that in the example described above, the rope receiving members 18 that receive the lifting rope 13 are provided on the side faces of the lifting attachment fitting 12, but in a case where the lifting rope 13 is unlikely to become damaged upon contact with the lifting attachment fitting 12, the rope receiving members 18 may be omitted.

Further, in the example described above, the attachment base 121 is attached to the upper lengthwise direction beam 4*a* of the side frame portion 4 by the rail clip 15 and the fastener 16, but instead, for example, the upper lengthwise direction beam 4*a* of the side frame portion 4 may be processed such that a bolt hole is provided in the upper lengthwise direction beam 4*a*, and the attachment base 121 may be attached to the upper lengthwise direction beam 4*a* by a bolt inserted into the bolt hole and a nut screwed to the bolt.

Furthermore, in the example described above, the reinforcing member 122 can be attached detachably to the pair of attachment bases 121, but the reinforcing member 122 maybe configured so as not to be detachable from the pair of attachment bases 121. For example, the reinforcing member 122 may be attached to the pair of attachment bases 121 by welding or the like.

Moreover, in the example described above, the rope receiving member 18 is a round bar having a circular cross-section, but as long as the surface of the rope receiving member 18 that receives the lifting rope 13 is curved, the rope receiving member 18 is not limited to this shape. For example, the rope receiving member 18 may be a bar having a semicircular cross-section.

Furthermore, in the example described above, the reinforcing member 122 is a non-telescopic angle bar, but the reinforcing member 122 may be configured to be telescopic. In this case, the reinforcing member 122 is constituted by a telescopic reinforcing member main body and a fixing tool for fixing the length of the reinforcing member main body. A telescopic body that is constituted by a plurality of mutually slidable angle bars so that the length of the reinforcing member main body is varied by sliding the angle bars relative to each other, for example, is used as the reinforcing member main body. Further, a bolt and a nut that fasten the angle bars together so that the angle bars are prevented from sliding relative to each other, for example, are used as the fixing tool.

Moreover, in the example described above, the escalator is divided into the plurality of units 1, and the respective units 1 are lifted by the lifting device. When the lifting subject is a small escalator, however, instead of dividing the escalator, the entire main frame may serve as the frame body to which the lifting rope 13 is hooked, and a single unit including the entire main frame and the unit device supported by the entire main frame maybe lifted by the lifting device.

Furthermore, in the example described above, this invention is applied to an escalator, but this invention may also be applied to a moving walkway (a passenger conveyor).

The invention claimed is:

1. A passenger conveyor lifting device for lifting a unit that includes a frame body constituting at least one lengthwise direction part of a main frame of a passenger conveyor, and a unit device supported by the frame body, the passenger conveyor lifting device comprising:

a lifting attachment fitting that includes a pair of attachment bases attached detachably to respective upper surfaces of a pair of side frame portions constituting respective width direction end portions of the frame body, and a reinforcing member connecting the pair of attachment bases above the unit device disposed between the pair of side frame portions; and a lifting rope that lifts the unit while directly attached to the respective side frame portions.

2. The passenger conveyor lifting device according to claim 1, wherein a rail clip is attached to each of the attachment bases by a fastener, and the attachment base is attached to the frame body by fastening the rail clip using the fastener in a condition where a beam of the side frame portion is sandwiched between the rail clip and the attachment base.

3. The passenger conveyor lifting device according to claim 1, wherein a rope receiving member that receives the lifting rope so as to prevent contact between the lifting rope and the lifting attachment fitting is provided on a side face of the lifting attachment fitting, and a surface of the rope receiving member that receives the lifting rope is curved.

4. The passenger conveyor lifting device according to claim 1, wherein the reinforcing member can be attached detachably to the pair of attachment bases.

5. The passenger conveyor lifting device according to claim 1, wherein the reinforcing member includes a telescopic reinforcing member main body and a fixing device to fix a length of the reinforcing member main body.

6. The passenger conveyor lifting device according to claim 1, further comprising:

a pair of curved rope contact surfaces, which respectively correspond to the pair of attachment bases, which prevent damage to the lifting rope on the attachment bases.

7. The passenger conveyor lifting device according to claim 6, wherein:

the curved rope contact surfaces are disposed on one of the corresponding attachment bases.

8. The passenger conveyor lifting device according to claim 6, wherein:

the curved rope contact surfaces are disposed above the side frame portions.

9. The passenger conveyor lifting device according to claim 1, wherein:

the directly attached lifting rope is hooked to the respective side frame portions.

10. A passenger conveyor lifting method for lifting a unit that includes a frame body constituting at least one lengthwise direction part of a main frame of a passenger conveyor, and a unit device supported by the frame body, the passenger conveyor lifting method comprising:

attaching a lifting attachment fitting that includes a pair of attachment bases and a reinforcing member, to the frame body by attaching detachably the pair of attachment bases to respective upper surfaces of a pair of side frame portions constituting respective width direction end portions of the frame body, and by disposing the reinforcing member above the unit device so as to connect the pair of attachment bases;

directly attaching a lifting rope to the pair of side frame portions;

lifting the unit by the lifting rope following the attaching of the lifting attachment fitting and the directly attaching of the lifting rope; and removing the lifting attachment fitting and the lifting rope from the frame body following the lifting.

11. The method according to claim 10, wherein the directly attaching comprises:

contacting the lifting rope to curved rope contact surfaces to prevent damage to the lifting rope on the attachment bases.

12. The method according to claim 10, wherein:

the directly attaching the lifting rope includes directly hooking the lifting rope to the pair of side frame portions.

13. A passenger conveyor lifting device for lifting a unit that includes a frame body constituting at least one lengthwise direction part of a main frame of a passenger conveyor, and a unit device supported by the frame body, the passenger conveyor lifting device comprising:

a lifting attachment fitting that includes a pair of attachment bases attached detachably to respective upper surfaces of a pair of side frame portions constituting respective width direction end portions of the frame body, and a rigid connection between the pair of attachment bases above the unit device disposed between the pair of side frame portions; and a lifting rope that lifts the unit while directly attached to the respective side frame portions.

14. The passenger conveyor lifting device according to claim 13, wherein a rail clip is attached to each of the attachment bases by a fastener, and the attachment base is attached to the frame body by fastening the rail clip using the fastener in a condition where a beam of the side frame portion is sandwiched between the rail clip and the attachment base.

15. The passenger conveyor lifting device according to claim 13, wherein a rope receiving member that receives the lifting rope so as to prevent contact between the lifting rope and the lifting attachment fitting is provided on a side face of the lifting attachment fitting, and a surface of the rope receiving member that receives the lifting rope is curved.

16. The passenger conveyor lifting device according to claim 13, wherein the rigid connection is detachably attached to the pair of attachment bases.

17. The passenger conveyor lifting device according to claim 13, further comprising:

a pair of curved rope contact surfaces, which respectively correspond to the pair of attachment bases, which prevent damage to the lifting rope on the attachment bases.

* * * * *